United States Patent [19]

Thuries

[11] Patent Number: 4,649,243

[45] Date of Patent: Mar. 10, 1987

[54] DOUBLE-ACTING, COMPRESSED GAS, HIGH TENSION CIRCUIT BREAKER WITH ACTUATING ENERGY ASSISTED BY THE THERMAL EFFECT OF THE ARC

[75] Inventor: Edmond Thuries, Pusignan, France

[73] Assignee: Alsthom, Paris, France

[21] Appl. No.: 818,420

[22] Filed: Jan. 13, 1986

[30] Foreign Application Priority Data

Jan. 16, 1985 [FR] France ..... 85 00611

[51] Int. Cl.[4] ..... H01H 33/88

[52] U.S. Cl. ..... 200/148 A; 200/148 R

[58] Field of Search ..... 200/148 A, 148 R

[56] References Cited

U.S. PATENT DOCUMENTS

| | | | |
|---|---|---|---|
| 4,163,131 | 7/1979 | Perkins | 200/148 A |
| 4,219,711 | 8/1980 | McConnell | 200/148 A |
| 4,450,330 | 5/1984 | Zuckler | 200/148 A |

FOREIGN PATENT DOCUMENTS

| | | | |
|---|---|---|---|
| 2358368 | 5/1975 | Fed. Rep. of Germany . | |
| 54-42979 | 3/1979 | Japan | 200/148 A |

*Primary Examiner*—Robert S. Macon

*Attorney, Agent, or Firm*—Sughrue, Mion, Zinn, Macpeak & Seas

[57] ABSTRACT

The invention relates to a double-acting, compressed gas, high tension circuit breaker in which the operating energy is assisted by the thermal effect of the arc, the circuit breaker comprises a moving assembly having main contacts and arcing contacts which is electrically connected to a first electrical connection point, a fixed assembly connected to a second electrical connection point of the circuit breaker, and a semi-moving assembly which is electrically connected to said fixed assembly and which is mechanically linked to said fixed assembly by resilient means, said semi-moving assembly having main contacts and arcing contacts which cooperate respectively with the main contacts and the arcing contacts of the moving assembly, the circuit breaker further including means (13, 36) for exerting a force on said semi-moving assembly (20) when an arc is being interrupted in order to displace the semi-moving assembly in the opposite direction to that in which the moving assembly (40) is displaced.

4 Claims, 3 Drawing Figures

DOUBLE-ACTING, COMPRESSED GAS, HIGH TENSION CIRCUIT BREAKER WITH ACTUATING ENERGY ASSISTED BY THE THERMAL EFFECT OF THE ARC

The present invention relates to a double-acting, compressed gas, high tension circuit breaker whose actuating energy is assisted by the thermal effect of the arc.

BACKGROUND OF THE INVENTION

The circuit breaker is filled with a good arc-quenching gas, e.g. sulfur hexafluoride, at a pressure of a few atmospheres. The circuit breaker is of the type which includes a so-called "thermal" volume in which the pressure is likely to increase considerably by virtue of its temperature rising when the circuit breaker is opened and an arc is struck between its arcing contacts. On the first zero crossing of the electric current, the gas expands and blasts the arc. Generally speaking, such circuit breakers also include a volume in which gas is mechanically compressed by a piston and is directed onto the arc to assist in extinguishing it. When low currents are to be interrupted (unloaded line) the mechanical blast effect is the major blast effect. Conversely, when high value currents are interrupted (e.g. short circuit currents) it is the thermal blast effect which is the major effect.

In such circuit breakers it is important for the actuating energy required to interrupt the circuit to be as small as possible. However, in most cases, the increase in pressure in the thermal volume has the effect of braking the movement of the circuit breaker moving assembly. Published German patent specification no. 2 358 368 describes a circuit breaker in which both sets of contacts are moving contacts (i.e. a double-acting circuit breaker) in which the arc energy is used both to assist in separating the contacts and to blast the arc.

In such a device, the energy required to actuate the circuit breaker is reduced, but this is to the detriment of arc blasting efficiency because of the high temperature to which the blast gas is raised. Preferred implementations of the present invention provide a thermal blast circuit breaker in which the pressure rise in the thermal chamber serves to reduce the energy required to operate the circuit breaker, while retaining proper arc extinguishing efficiency.

In order to do this, energy from the arc is used to assist in displacing the contacts relative to each other, but a portion of the arc energy is taken to compress a volume of cold gas without heating the gas, which compressed cold gas is used to blast the arc.

SUMMARY OF THE INVENTION

The present invention provides a double-acting, compressed gas, high tension circuit breaker in which the operating energy is assisted by the thermal effect of the arc, the circuit breaker comprising a moving assembly having main contacts and arcing contacts, which assembly is electrically connected to a first electricity connection point, a fixed assembly connected to a second electricity connection point of the circuit breaker, a semi-moving assembly which is electrically connected to said fixed assembly which is mechanically connected to said fixed assembly by resilient means, and which carries main contacts and arcing contacts which co-operate respectively with the main contacts and the arcing contacts of the moving assembly, the circuit breaker including the improvement of a chamber constituted by a first piston and a second piston which are fixed to the fixed assembly and by and end plate common to a first and to a second volume both of which are of annular section and in which said pistons slide respectively, said end plate and said volumes constituting a portion of the semimoving assembly, said pistons being provided with piston rods passing through said end plate and having at least one duct putting the arcing zone into communication with the inside of the chamber, the first volume including means for causing the inside of the first volume to communicate with the outside of the semi-moving assembly, and the second volume being in communication with the arcing zone.

BRIEF DESCRIPTION OF THE DRAWINGS

An embodiment of the invention is described by way of example with reference to the accompanying drawings, in which.

MORE DETAILED DESCRIPTION

Figure 1:
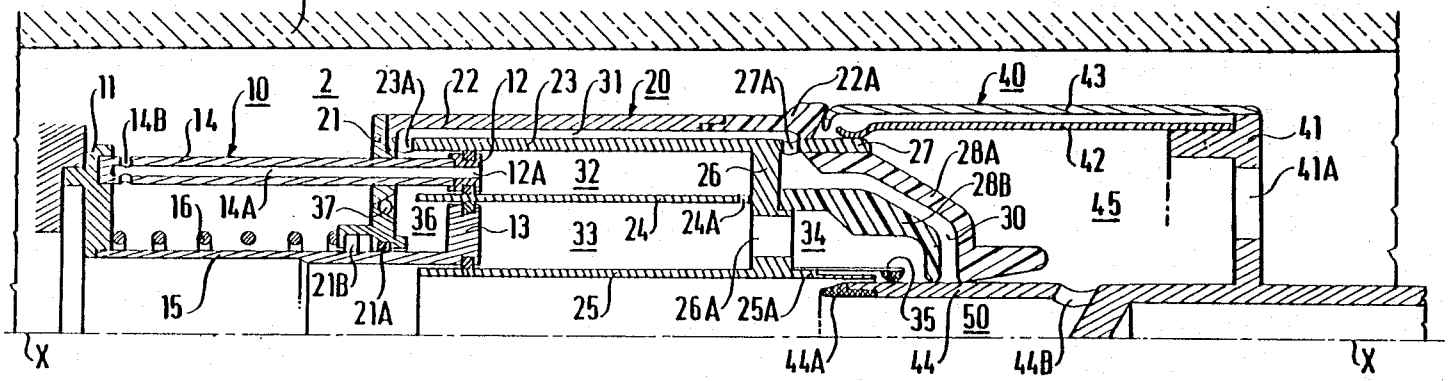
FIG. 1 is a diagrammatic axial section through a portion of a circuit breaker embodying the invention and in the closed position.
Figure 2:
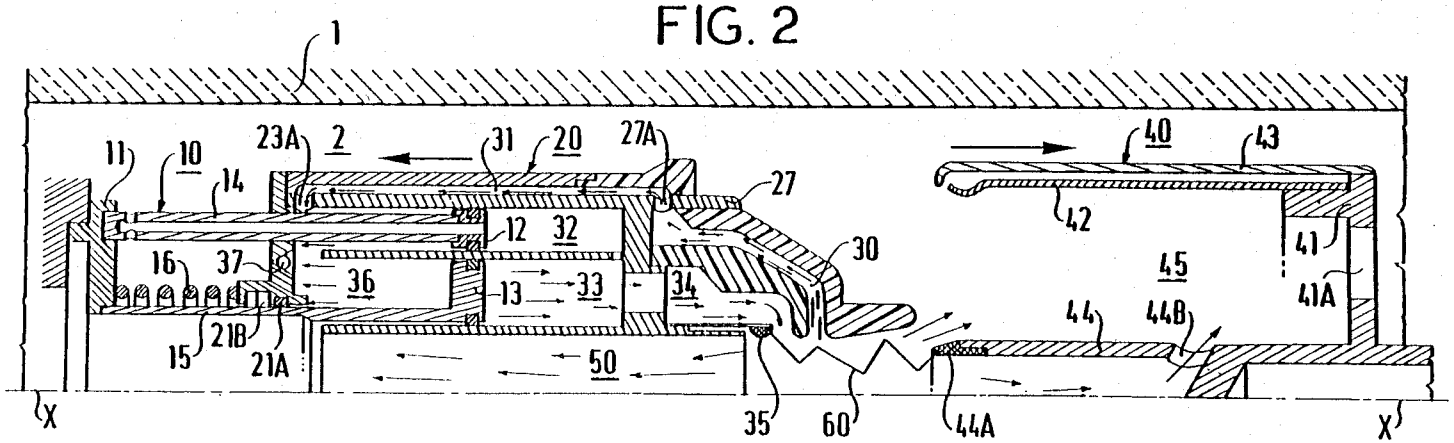
FIG. 2 is a diagrammatic axial section through a portion of the FIG. 1 circuit breaker shown during opening to break a high intensity current, and in particular showing the double action of the moving parts.
Figure 3:
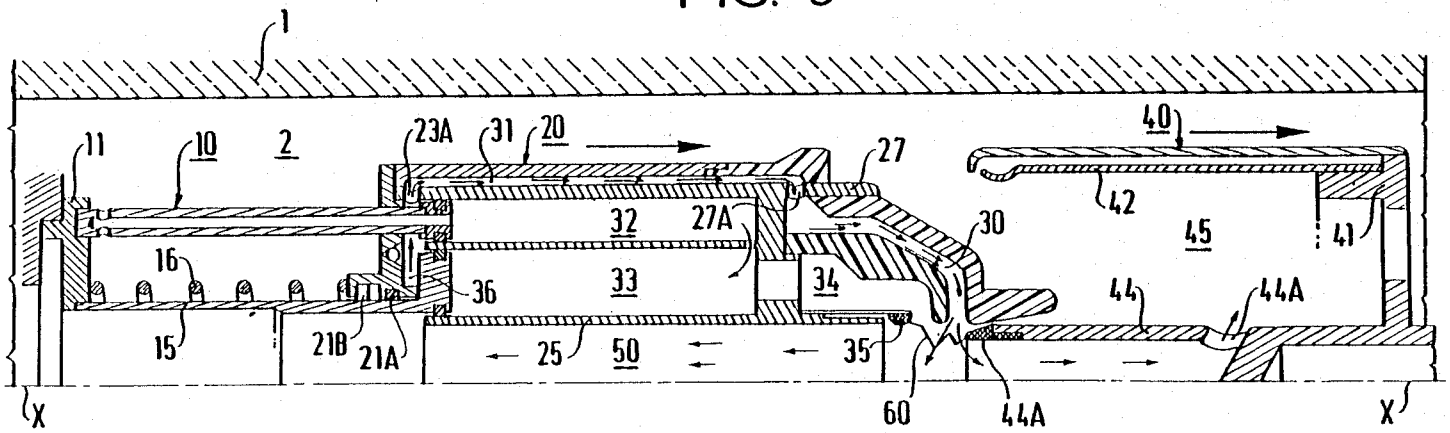
FIG. 3 is a diagrammatic axial section through the FIG. 1 circuit breaker showing it in a position which corresponds to interrupting a low intensity current.

In FIGS. 1 to 3, reference 10 designates a fixed assembly of the circuit breaker, reference 20 designates a semi-moving assembly, and reference 40 designated a moving assembly. These assemblies are cylindrical about an axis XX and they are enclosed in a outer envelope 1 which may be made of metal or of an insulating material.

The circuit breaker is filled with a gas having good dielectric qualities such as sulfur hexafluoride at a pressure of a few atmospheres.

Reference 2 designates the volume lying between the outer envelope 1 and the parts 10, 20 and 40.

The fixed assembly comprises a solid ring 11 which is connected to an electricity connection point (not shown) and two fixed pistons 12 and 13 of unequal annular areas. The piston 12 is fixed to the ring by a plurality of rods such as 14, and at least one of the rods 14 has a longitudinally extending channel 14A with orifices 14B providing access between the longitudinal channel and the outside of the rod. The piston 12 has at least one channel 12A extending a channel 14A in such a manner that the pressure exerted on the face of the piston furthest from its rods always remain equal to the pressure in the volume 2.

The piston 13 is connected to the ring 11 by a tubular metal rod 15. The piston 13 and its rod 15 are preferably machined from a single piece of metal.

The assembly 20 is said to be a "semi-moving" assembly since its axial movement is limited by a spring 16 which bears against the ring 11 and against a first circular end plate 21 of the semi-moving assembly.

The semi-moving assembly comprises four coaxial metal tubes 22, 23, 24, and 25.

The tube 22 is fixed at one end to a first end plate 21, its other end is extended by an insulating sleeve 22A.

The tube 23 is fixed at one end to the first end plate 21 and its other end is fixed to a second end plate 22.

Orifices 23A pass through the tube 23 close to the first end plate 21.

The tube 23 extends beyond the end plate 26 by means of a tubular portion 27 which acts as the main contact when the circuit breaker is closed.

An insulating blast nozzle is fixed to said tubular portion 27 and to the end plate 26. The nozzle comprises two parts 28A and 28B which are separated by a volume 30 which communicates via holes 27A through the contact 27 with the volume 31 lying between the tubes 22 and 23. (In a variant the nozzle could be a single part having a channel passing through if from end-to-end).

The tube 24 is fixed to the end plate 26, and it is shorter than the tube 23 so as to leave a free space between said tube and the end plate 21.

The annular volume lying between the tubes 23 and 24 and along which the piston 12 is capable of sliding in sealed manner, is referenced 32.

The tube 25 is fixed to the end plate 26 and is of substantially the same length as the tube 24.

The annular volume lying between the tubes 24 and 25 and along which the piston 13 is slidably mounted in sealed manner is referenced 33.

The tube 25 extends beyond the end plate 26 in the form of a portion 25A having arcing contact fingers 35. The volume 33 communicates with the volume 34 lying between the portion 28B of the nozzle and the contact fingers 35 by means of large orifices 26A.

The volumes 32 and 33 communicate with each other via small orifices 24A.

In practice, the tubes 23, 24, and 25, and the end plate 26 could be made from a single piece of machined metal.

The end plate 21 has sealing rings 21A which co-operate with the tube 15 to close the chamber 36 as delimited by the pistons 12 and 13, the tube 15, the end plate 21, and the tube 23.

In addition, the end plate 21 has sliding electric contacts 21B for ensuring electrical continuity between the tube 15 and the semi-moving assembly.

Finally, the end plate 21 is provided with a non-return valve 37 whose function is explained below. The valve is arranged to open only if the pressure inside the volume 36 falls below the pressure inside the volume 2.

The moving assembly comprises a solid ring 41 connected to a circuit breaker electricity connection point (not shown) and to operating means (likewise not shown).

Contact fingers 42 surrounded by a tube 43 are fixed to said ring. The fingers 42 co-operate and engage with the tube 27 to pass electric current when the circuit breaker is in the closed position. The tube 43 comes into contact with the insulating portion 42A of the semi-moving assembly. In the closed position of the circuit breaker, the spring 16 is partially compressed.

The ring 41 also carries a tubular contact 44 which is terminated by a portion 44A made of material which withstands the effects of arcing.

When the circuit breaker is closed, the tube 44 is in contact with the fingers 35 and the ends of the portions 28A and 28B of the nozzle.

The volume 45 lying between the contacts 41 and the contact 44 communicates firstly via orifices 44B through the tube 44 with the volume 50 adjacent to the axis, and secondly via large orifices 41A with the volume 2.

The circuit breaker operates as follows.

In the closed position, current passes from the ring 11 to the ring 41 via the tube 15, the contacts 21B, the end plate 21, the tube 23, the contact 27, and the fingers 41.

INTERRUPTING HIGH INTENSITY CURRENTS (short circuits)

The moving assembly moves to the right in the figures. The semi-moving assembly also moves towards the right under the action of the spring 16, but it moves more slowly than the moving assembly because of the compression created in the volume 36.

When the fingers 35 lose contact with the tube 44 an arc 60 is struck between the ends of these parts.

The temperature in the vicinity of the arc increases and thus increases the pressure, which pressure increase is transmitted via the volumes 30 and 31 into the chamber 36 and, via the orifices 26A, into the volume 33.

Since the area S2 of the end plate 21 is greater than the area S1 of the piston 13 the semi-moving assembly then moves to the left against the thrust of the spring 16.

This increases the speed at which the arcing contacts move apart.

A portion of the energy required for interrupting the current is provided by the arc itself, and this additional energy increases with increasing current intensity.

On the first zero crossing of the current, the pressure falls in the contact zone. The gas in the volume 33 which has been compressed both by heating and by the action of the piston 13 then expands and blasts the arcing zone. At the same time, the spring 16 returns the semi-moving assembly and the gas in the volume 32 is expelled via the volumes 31 and 30, thereby also contributing to blasting the arc and providing excellent behavior in the face of voltage increases.

INTERRUPTING LOW INTENSITY CURRENTS (circuit breaker unloaded or capacitor current)

The arc produces a temperature rise which is insufficient to displace the semi-moving assembly 20 against the spring 16.

The arc is extinguished by a blast of gas compressed in the volume 36, and passing through the volumes 31 and 30 (see FIG. 3).

When the circuit breaker is engaged, the non-return valve opens thereby refilling the volume 36.

I claim:

1. In a double-acting, compressed gas, high tension circuit breaker in which the operating energy is assisted by the thermal effect of the arc, said circuit breaker comprising; an outer envelope housing a gas having good dielectric properties, a moving assembly within said envelope having main contacts and arcing contacts, means for electrically connecting said moving assembly to a first electricity connection point, a fixed assembly within said envelope connected to a second electricity connection point of the circuit breaker, a semi-moving assembly within said envelope interposed longitudinally between said moving assembly and said fixed assembly, means electrically connecting said semi-moving to said fixed assembly, resilient means mechanically connecting said semi-moving assembly to said fixed assembly, main contacts and arcing contacts carried by said semi-moving assembly for engagement respectively with the main contacts and the arcing contacts of the moving assembly, the improvement comprising a chamber constituted by a first piston and a second piston fixed to the fixed assembly and by an end plate common to a first and to a second volume both of which are of annular section, in which said pistons slide respectively, said end plate and said volumes constituting a portion of the semi-moving assembly, said pistons being provided with piston rods passing through said end plate, at least one duct placing the arcing zone into communication with the inside of the chamber, means communicating the inside of the first volume with the outside of the semi-moving assembly, and means communicating the second volume with the arcing zone; whereby, the energy from the arc is used to assist in displacing the contacts of the circuit breaker relative to each other and wherein a portion of the arc energy is taken to compress a cold volume of said gas without heating the gas and employing said compressed cold gas to blast the arc.

2. A circuit breaker according to claim 1, further comprising a blast nozzle, and wherein said duct opens to said blast nozzle disposed at one end of said second cylindrical volume communicating with the arcing zone.

3. A circuit breaker according to claim 2, wherein said means communicating the inside of the first volume with the outside of the semi-moving assembly comprises a duct extending along said piston rod, a hole through the first piston communicating with said duct along the piston rod, and holes opening from the other end of said duct to the outside of the semi-moving assembly.

4. A circuit breaker according to claim 2 or 3, wherein said end plate comprises a non-return valve which opens only when the pressure in said chamber falls below the pressure outside the semi-moving assembly.

* * * * *